US007897916B2

(12) United States Patent
Sudakov et al.

(10) Patent No.: US 7,897,916 B2
(45) Date of Patent: Mar. 1, 2011

(54) TANDEM ION-TRAP TIME-OF-FLIGHT MASS SPECTROMETER

(75) Inventors: Michael Sudakov, Cheshire (GB); Li Ding, Cheshire (GB)

(73) Assignee: Shimadzu Research Laboratory (Europe) Limited, Manchester (GB)

( * ) Notice: Subject to any disclaimer, the term of this patent is extended or adjusted under 35 U.S.C. 154(b) by 324 days.

(21) Appl. No.: 10/598,194

(22) PCT Filed: Feb. 23, 2005

(86) PCT No.: PCT/GB2005/000671

§ 371 (c)(1), (2), (4) Date: Apr. 20, 2007

(87) PCT Pub. No.: WO2005/083742

PCT Pub. Date: Sep. 9, 2005

(65) Prior Publication Data

US 2008/0035842 A1 Feb. 14, 2008

(30) Foreign Application Priority Data

Feb. 26, 2004 (GB) ..... 0404285.9

(51) Int. Cl.
*H01J 49/42* (2006.01)

(52) U.S. Cl. ..... 250/282; 250/281; 250/283; 250/288; 250/290; 250/293

(58) Field of Classification Search ..... 250/281–300
See application file for complete search history.

(56) References Cited

U.S. PATENT DOCUMENTS

| | | | | |
|---|---|---|---|---|
| 5,420,425 | A * | 5/1995 | Bier et al. | 250/292 |
| 5,468,958 | A * | 11/1995 | Franzen et al. | 250/292 |
| 5,569,917 | A | 10/1996 | Buttrill, Jr. et al. | |
| 5,576,540 | A * | 11/1996 | Jolliffe | 250/292 |
| 5,650,617 | A * | 7/1997 | Mordehai | 250/290 |

(Continued)

FOREIGN PATENT DOCUMENTS

EP 1302973 4/2003

(Continued)

OTHER PUBLICATIONS

Li Ding et al., "A simulation study of the digital ion trap mass spectrometer", International Journal of Mass Spectrometry vol. 221 (2002) p. 117-138.

(Continued)

*Primary Examiner* — Robert Kim
*Assistant Examiner* — Michael J Logie
(74) *Attorney, Agent, or Firm* — Westerman, Hattori, Daniels & Adrian, LLP

(57) ABSTRACT

A tandem linear ion trap and time-of-flight mass spectrometer, where the ion trap has a straight central axis orthogonal to the flight path of the mass spectrometer. The ion trap comprises a set of electrodes, (401, 403, 402, 404) at least one of the electrodes has a slit for ejecting ions towards the mass spectrometer; a set of DC voltage supplies (+V, −V, V1, V2) to provide discrete DC levels and a number of fast electronic switches (409) for connecting/disconnecting the DC supplies to at least two of the electrodes; a neutral gas filling the ion trap and a digital controller to provide a switching procedure of ion trapping, manipulation with ions, cooling and including a state at which all ions are ejected from the ion trap towards the mass spectrometer.

7 Claims, 15 Drawing Sheets

U.S. PATENT DOCUMENTS

| | | | | |
|---|---|---|---|---|
| 5,763,878 | A * | 6/1998 | Franzen | 250/292 |
| 6,380,666 | B1 * | 4/2002 | Kawato | 313/359.1 |
| 6,545,268 | B1 | 4/2003 | Verentchikov et al. | |
| 6,570,151 | B1 * | 5/2003 | Grosshans et al. | 250/282 |
| 6,700,117 | B2 * | 3/2004 | Franzen | 250/287 |
| 6,900,430 | B2 * | 5/2005 | Okumura et al. | 250/281 |
| 6,900,433 | B2 * | 5/2005 | Ding | 250/292 |
| 6,977,374 | B2 * | 12/2005 | Kawato | 250/292 |
| 6,989,534 | B2 * | 1/2006 | Schubert et al. | 250/292 |
| 7,193,207 | B1 * | 3/2007 | Ding et al. | 250/292 |
| 7,285,773 | B2 * | 10/2007 | Ding et al. | 250/282 |
| 7,297,960 | B2 * | 11/2007 | Brown et al. | 250/396 R |
| 7,498,571 | B2 * | 3/2009 | Makarov et al. | 250/292 |
| 7,501,622 | B2 * | 3/2009 | Kawato | 250/292 |
| 2002/0092980 | A1 | 7/2002 | Park | |
| 2003/0066958 | A1 * | 4/2003 | Okumura et al. | 250/286 |
| 2003/0183759 | A1 * | 10/2003 | Schwartz et al. | 250/292 |
| 2004/0026613 | A1 * | 2/2004 | Bateman et al. | 250/281 |
| 2005/0017170 | A1 * | 1/2005 | Schwartz et al. | 250/292 |
| 2005/0040330 | A1 * | 2/2005 | Kaufman et al. | 250/293 |

FOREIGN PATENT DOCUMENTS

| | | | |
|---|---|---|---|
| EP | 1302973 | A | 2/2004 |
| JP | 2003-123685 | A | 4/2003 |
| JP | 2003-512702 | A | 4/2003 |
| WO | 99/30350 | A1 | 6/1999 |
| WO | 01/29875 | A2 | 4/2001 |
| WO | 0129875 | A | 4/2001 |
| WO | 03/041107 | A2 | 5/2003 |

OTHER PUBLICATIONS

Vladimir M. Doroshenko et al., "A Quadrupole Ion Trap/Time-of-flight Mass Spectrometer with a Parabolic Reflectron", Journal of Mass Spectrometry vol. 33(1998) p. 305-318.

Ling He et al., "Detection of Oligonucleotides by External Injection into an Ion Trap Storage/Reflectron Time-of-flight Device", Rapid Communications in Mass Spectrometry, vol. 11 (1997), p. 1440-1448.

Jae C. Schwartz et al., "A Two-Dimensional Quadrupole Ion Trap Mass Spectrometer", American Society of Mass Spectrometry, vo.13 (2002), p. 659-669.

Japanese Office Action dated Mar. 9, 2010, issued in corresponding Japanese Patent Application No. 2007-500284.

Chinese Office Action dated Apr. 10, 2009, issued in corresponding Chinese patent application No. 200580005746.0.

* cited by examiner

| | "trap +" | "trap -" | "eject" |
|---|---|---|---|
| Y electrodes | +V | -V | -V |
| X left | -V | +V | +V1 |
| X right | -V | +V | +V2 |

TANDEM ION-TRAP TIME-OF-FLIGHT MASS SPECTROMETER

FIELD OF THE INVENTION

This invention relates to ion trap and time-of-flight mass spectrometry, and more particularly is concerned with a method of ejecting ions out of the trap into time-of-flight mass spectrometer.

BACKGROUND OF THE INVENTION

Time-of-flight (TOF) mass spectrometers distinguish ions of different mass-to-charge ratio by the difference of there flight time from the ion source to detector. Thus TOF method essentially requires the ion source from which ions can be pulsed out having the same initial position and energy. In practice this is not possible due to inherent thermal energy spread and position spread of ions inside the ion source. Modern ToF mass spectrometers use acceleration of ions by high voltage pulse out of the pulsar region. Before ejection the ion cloud occupy comparatively wide volume and have substantial energy spread. After ejection out of the pulsar different ions of the same mass-charge ratio have different energy partly due to difference in initial position and partly due to initial velocity spread. Both factors introduce spread into the time of ion arrival to detector, thus limiting the resolution of ToF mass measurement. Energy distribution of ions, which is introduced by position spread, can be corrected by energy focusing devices like reflectron. The energy distribution, which results from velocity spread cannot be corrected by any combination of electrostatic fields and appears as a major factor limiting mass resolution of ToF. Imagine, for example, two ions of identical mass-to-charge ratio (m/z) positioned in the same point in the ion trap, but having different velocity. Both ions have the same absolute velocity V but velocity of the first ion is directed towards ToF while second ion has velocity in opposite direction. Upon application of the extraction field both ions have the same acceleration $a=E/(m/z)$, where E—is strength of the extraction electrical field. While the first ion starts moving towards ToF, the second ion has to move in opposite direction until its velocity becomes zero and reversed. After the time $\delta t=2V/a$ the second ion arrives into original position having the same velocity as first ion in the beginning of ejection. At this moment second ion is undistinguishable from the first ion. Time $\delta t$ elapsed from the beginning of ejection towards reverse of second ion is called "turn-around-time". First ion has started earlier by the time $\delta t$ and will arrive at the detector earlier. Mass measurement in ToF is essentially based on the measurement of the time of ions arrival to detector, hence the two ions of identical m/z will arrive to detector within time difference of $\delta t$ and this cannot be corrected by any electrostatic field configuration. In real devices ions always have thermal velocity spread $\delta V$ and turn-around-time $\delta t$ due to thermal spread limits the resolution of ToF spectra by theoretical value $R=Ttof/2\ \delta t$, where Ttof is the total flight time. Thermal energy spread per one degree of freedom at 300 K equals 0.013 eV. For example, for singly charged ions of mass 1000 Da corresponding velocity spread equals 100 m/s. Upon application of 10 kV acceleration voltage on distance of 10 mm the total turn-around-time equals $\delta t=1.1$ ns. Assuming the total flight path of 4 m the time-of-flight equals 91 μs. Hence theoretical resolution limit due to turn-around-time in this case is 41.000.

It is known in the art of mass spectrometry, that ion traps can provide an improved ion source for TOF mass spectrometer [1]. By using momentum-dissipating collisions of ions with light buffer gas the ion cloud can be collected near the centre of the trap to a size of less than 1 mm. Kinetic energy spread of ions in such cloud is believed to be close to thermal. Modern methods of ion trapping are based on the use of harmonic periodical voltages (trapping RF) applied to one or several electrodes of the ion trap. Voltage power supply for such RF contains high-Q resonator, which keeps all the energy of the RF field during ion trapping period. Typical ion trap device with internal size of 10 mm can require voltages up to 10 kVo-p for ion trapping. In order to optimise ejection conditions the RF voltage should be switched off upon ejection of ions into TOF [2]. In practice it is extremely difficult due to huge amount of energy in RF resonator. Extraction pulse should be applied not later than few μs after RF switch off, otherwise ions will be lost on the electrodes. It follows that residual "ringing" RF is still present in the trapping volume upon application of extraction pulse. Such ringing deteriorates accuracy and resolution of TOF mass spectra by introducing hardly predictable acceleration fields during ejection. Assuming, that residual RF ringing is only 0.1% of original voltage the magnitude of oscillating voltage is several Volt. The energy spread of ions introduced by this voltage difference is of the order of several electron-volt, which is by two orders of magnitude bigger than thermal energy spread of ions at 300 K. The objective of present invention is to improve performance of TOF mass analysis in terms of resolution and mass accuracy by eliminating the energy spread of ions, which is introduced by residual RF during ejection of ions out of the ion trap.

PRIOR ART

The use of ion trap as an ion source for TOF has been discussed in a number of patents. A 3D ion trap with ejection and post acceleration of ions into the TOF flight path is disclosed in U.S. Pat. No. 5,569,917 [3]. The method described in this patent uses comparatively low extraction voltages (below 500V) and hence does not allow efficient eliminating of the turn-around time. Improved method of extraction from 3D ion trap is disclosed by Kawato in U.S. Pat. No. 6,380,666 [4]. This method uses extraction by high voltage pulse (5 kV and more) and specific combination of voltages on extraction electrodes to achieve almost parallel beam of ions. Both patents suggest that RF is not present during ejection process, but do not teach how this can be done in practice. Ejection of ions out of the trap into a pulsar and orthogonal (with respect to extraction flight-path) post acceleration into TOF is described in EP 1 302 973 A2 [5]. In this case the turn-around-time in the direction of ion extraction does not affect TOF resolution. Ions can be extracted using relatively low voltages, while HV pulse is applied afterwards when ions arrive into pulsar. Such ejection method should be optimised in order to give smallest velocity spread in the orthogonal direction, because it will decide the turn-around-time for orthogonal acceleration from the pulsar. This kind of optimisation was not used in a method of cited patent application [5]. It is obvious that such optimisation is hardly possible if sinusoidal RF inside the trap is still running during the ejection process.

Over the last few years there was an effort to increase the number of ions that can be stored inside the trap and used for mass analysis. It is known that a typical 3D trap can hold up to $10^7$ ions, but high resolution manipulations with ions by using supplementary AC signals is only possible if the total amount of elementary charges inside 3D trap is below few thousands. Talking into account typical time of 100 ms for ion manipulations inside the trap one arrives with total throughput of 10.000 charges per second or analytical current of 0.0016 pA. Such throughput is not acceptable for most applications as modern ion sources can provide total ion current of several nA. Influence of space charge is significantly smaller for a linear ion trap (LIT). Electrode structure of LIT is based on quadrupole with four parallel electrodes elongated along the same axis. In such ion trap ions are confined in radial direction by periodical high frequency (typically 0.5-3 MHz) electrical field. Motion of ions along the axis is restricted by DC voltage applied to the entrance and exit electrodes of the LIT. In equilibrium conditions ions in such trap tend to collect along z-axis in a cigar-like cloud. Assuming that the radial size of the cloud is the same as in 3D trap (typically 0.2-1.0 mm) and the length of the cloud is 10 mm, the total number of ions is at least 10 times bigger before the space charge becomes significant [6].

The use of a linear ion trap in combination with TOF is discussed in a number of patents. D. Douglas in WO 99/30350 [7] describes a tandem LIT-TOF instrument in which ions are manipulated within the LIT and then released along the axis of the trap. A pulsar is positioned inline with the ion trap and ions are pulsed into TOF upon arrival into pulsar. TOF axis is orthogonal to the LIT axis and in order to achieve high resolution the velocity spread of ions in orthogonal direction (with respect to the LIT axis) should be minimised. Collimating the ion beam from the LIT using small diaphragm can do this. In general the method suffers from mass discrimination of ions. At the moment when extraction pulse is applied the pulsing region contains only ions of certain mass range—ions that just arrived and not gone yet. Only a limited portion of mass range can be extracted into TOF at a time. The wide mass range of ions can be analysed by obtaining mass spectra of several sub ranges. Analysis of each sub range requires refill of the ion trap with ions and repeat all manipulations. As a result, such instrument has low throughput.

J. Franzen in U.S. Pat. No. 5,763,878 [8] describes a method of ion ejection directly from a linear trap into the ion path of ToF. According to the method ions are passed from the ion source into the LIT, cooled down by collisions with buffer gas and collected along the axis of the trap. The voltage supply for LIT is capable of supplying at least two voltage configurations one for ion trapping and another for extraction. Upon application of extraction voltages ions are pulsed out in the direction orthogonal to the axis of the trap. They pass between the rods and appear on the flight path of ToF. The method suggests that the RF is completely switched off upon extraction and replaced by certain combination of DC voltages on the electrodes of the trap. The patent does not teach how to switch off the RF field although it is mentioned as a difficult practical problem. The optimum voltage configuration on the electrodes and the timing of extraction are also not described.

Recently a 3D ion trap with so-called "digital drive" was proposed [9]. In this device the voltage of the ring electrode is switched every cycle from positive to negative discrete DC levels. A computer controls switching time with high precision and capable of generating any given switching sequence. It was found that ions of a wide mass range can be trapped inside such trap by switching between only two discreet DC levels (positive and negative) periodically with equal time for each level. Such waveform is referred as square waveform with 50% duty cycle. All traditional modes of ion trap operation are possible with the use of such a trapping method [10]. A method to combine digital ion trap with TOF analysis and benefits of such tandem was not described so far.

SUMMARY OF THE INVENTION

According to the invention there is provided a tandem linear ion trap and time-of-flight mass spectrometer, the ion trap having a straight central axis orthogonal to the flight path of said time-of-flight mass spectrometer and comprising; a set of electrodes, at least one said electrode having a slit for ejecting ions towards said time-of flight mass spectrometer; a set of DC voltage supplies to provide discrete DC levels and a number of fast electronic switches capable of connecting and disconnecting said DC supplies to at least two said electrodes of said ion trap; a neutral gas filling the volume of said ion trap in order to reduce the kinetic energy of trapped ions towards equilibrium; a digital controller to provide a switching procedure for ion trapping, manipulations with ions, cooling and including one state at which all ions are ejected from said ion trap towards said time-of-flight mass spectrometer.

According to the invention there is also provided a method of extracting ions from a linear ion trap, said ion trap being driven by a set of digital switches, said method comprising the following steps; trapping said ions in said ion trap by switching between a set of trapping states on the electrodes of said ion trap; cooling said trapped ions by collisions with a buffer gas down to equilibrium: and switching from a pre-selected trapping state to a final ejection state in a pre-selected time.

The present inventors have realised, that the combination of a digital ion trap with TOF provides a tandem mass spectrometer with improved performance. The quality of TOF mass analysis such as resolution and mass accuracy can be improved by optimising conditions of ion ejection into TOF, which is only possible if fields are constant during the ejection process. In order to achieve such conditions authors propose to use the ion trap with digital drive, so that the voltages within the trap remain constant with high precision on application of extraction pulses. Thus the extraction voltages and switching time can be optimised in such way, that ion cloud leaves the ion trap having optimum phase-space distribution for further processing. Further processing can include mass analysis using TOF, or post acceleration stage of TOF mass spectrometer, or it can be any other ion optical device that requires pulses of ions. In each case the distribution of ion positions and velocities can be optimised for each particular purpose. After ejecting of ions out of the trap the trapping waveform is returned to original state allowing the next cycle of ion introduction, manipulation and mass analysis.

In preferred embodiments the invention includes an ion source with transmission ion optics including storing and pulsing ion guide, a linear ion trap filled with neutral gas of mTorr or higher pressure and a time-of-flight analyser. Ion trap is driven by a digital switches connected to all four main electrodes in order to provide periodic trapping potential consisting of at least 2 discreet DC levels. A square wave with equal positive and negative DC levels is preferable as the most simple trapping waveform allowing to trap a wide mass range of ions. Ions from the ion source are transmitted into a linear ion trap and injected into the trapping volume from a region of low field near the central axis of the trap. Ions are manipulated within the trap in a desired manner. These manipulations can include several stages of cooling, isolation of selected ion species by removing all ions with other mass-to-charge ratio and fragmentation of ions by using any of methods known in the art such as collisionally induced dissociation (CID), surface induced dissociation (SID), electron assisted dissociation, photon induced dissociation or other. Finally, remaining ions are cooled down by collisions with light buffer gas and collected near the central axis of the trap in a cigar-like cloud. At appropriate time the period of the trapping square wave is changed to a longer value and the extraction pulse is applied shortly after that. At least one of the electrodes of a linear ion trap has a slit through which the ions are ejected out of the trap. Digital signal generator (DSG) allows controlling the actual voltage state on the electrodes of the trap before the period change applies (switching state). The switching state, the duration between the start of last state and the start of the extraction pulse (duration of the last state prior to ejection) is adjusted in such way as to produce the best distribution of ions for further processing in TOF mass analyser. In preferred embodiments the TOF has a flight path orthogonal to the axis of linear ion trap and equipped with an ion mirror (reflectron).

In the first preferred embodiment the ions are ejected out of the trap into a pulsar, which is located parallel to the axis of ion trap and orthogonal to the TOF axis. On arrival of ions into the pulsar a high voltage pulse is applied to the electrodes of the pulsar in order to accelerate ions into the ion path of TOF. Acceleration voltages in the pulsar are as big as possible in order to reduce the turn-around time of ions. Ions are reversed in the TOF by an ion mirror and focused to the detector in such way that ions of the same mass-to-charge ratio arrive as close to each other in time as possible. A wide multi channel plate can be used as a detector. Arriving at the detector ions produce electrical pulses in the circuit, which are registered by a recording system. A digitiser with high sampling speed (1 Gsample/s or over) and high dynamic range (12 bit or over) is preferable.

In another preferred embodiment ions are ejected out of the trap directly into the flight path of the TOF, which is positioned orthogonal with respect to the ion trap axis and almost inline with the ejection flight path of ions. A small angle between the flight path of ejected ions and the TOF flight path can be introduced in order to allow deflection of ions into detector. Operation of the TOF and detector system is the same as in previous case. Power supply for an ion trap is different from previous case in respect of the voltages applied upon extraction of ions. In this case ions are ejected directly into the flight path and extraction voltages should be as high as possible. Power supply for extraction electrodes allows at least 3 DC levels—positive and negative voltages for ion trapping and high voltage for extraction. Additional switch is required for protecting comparatively low-voltage trapping circuit from high extraction voltage.

In yet another preferred embodiment the trapping of ions is achieved by driving only one set of the rods of the linear ion trap (Y electrodes) by switching between positive and negative DC levels. The high voltage switches for extraction are connected to another pair of rods (X electrodes) at least one of which has a slit for ejecting ions towards TOF. This kind of power supply is referred as "two-pole" digital trapping waveform. An advantage of this configuration is the possibility of separating the high voltage and trapping voltage supply from each other, which simplifies electronics and reduces the overall cost of instrument. As a result of such separation, the digital driving waveform on Y electrodes is not switched off during ejection. Only the switching period is changed to a longer value allowing all ions to be ejected from the trap with assistance of high voltage pulse.

BRIEF DESCRIPTION OF THE DRAWINGS

The above and further advantages of this invention can be better understood by the following description taking in conjunction with the accompanying drawings, in which.

DETAILED DESCRIPTION OF THE INVENTION

Figure 1:
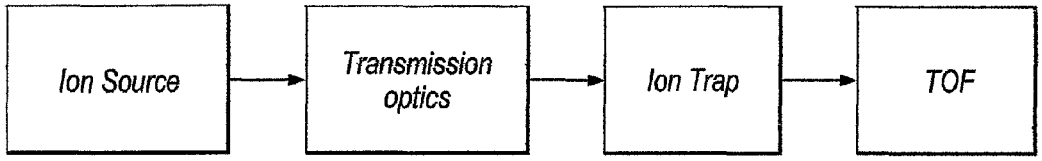
FIG. 1 is a block diagram of IT-TOF tandem instrument of the preferred embodiments.

Referring to FIG. 1 there is a block diagram of a tandem IT-TOF mass spectrometer including the ion source, means to transmit ions into the ion trap and time-of-flight mass spectrometer. The ion source is positioned external to the ion trap.

Ions can be generated in the ion source by any of the methods known in the art. In particular the electrospray ion source and MALDI are most commonly used for ionisation of molecules of biological nature. Ion source can operate at elevated pressure and ions are collected from ion source and transmitted through regions of differential pumping into the ion trap with the help of RF ion guides. Ions are manipulated inside the trap and prepared for mass analysis using TOF.

Figure 2:
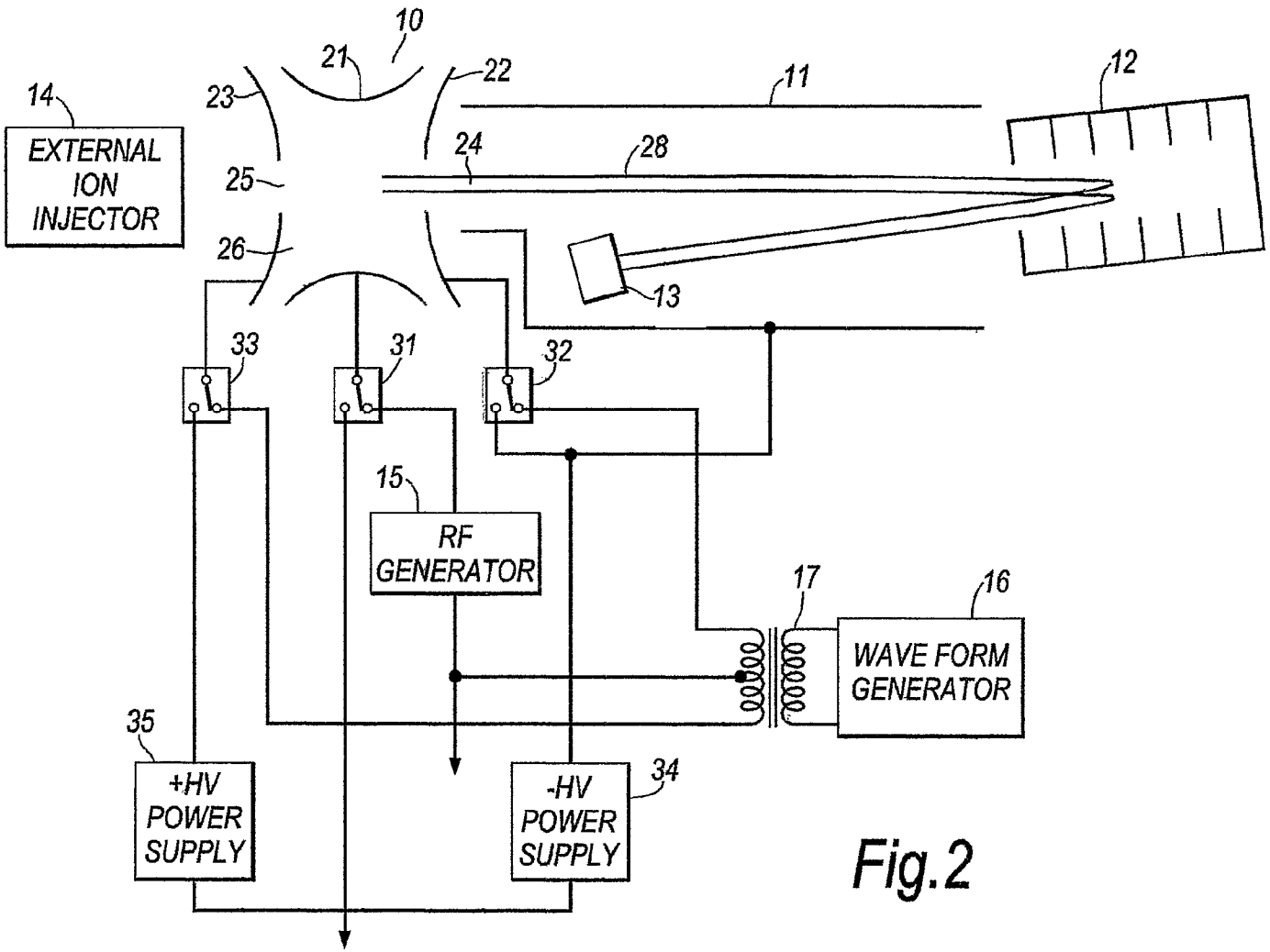
FIG. 2 is a IT-TOF tandem of prior art with conventional RF and ejection directly into the ion path of the TOF based on 3D ion trap.
Figure 3A:
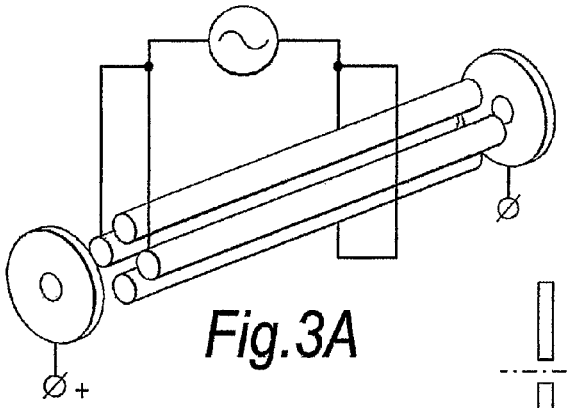
FIG. 3 is a quadrupole linear ion trap electrode geometry arrangement and voltage supply for ion trapping using conventional RF power supply. A. 3D view of electrode arrangement. B. Cross sectional view in X-Z plane of a LIT with stopping diaphragms on the entrance and exit. C. Cross sectional view in X-Z plane of a segmented LIT including 3 quadrupole segments. D. Cross sectional view in X-Y plane of a LIT with hyperbolic electrodes and ejection slit and conventional RF power supply for ion trapping in radial direction.
Figure 3B:
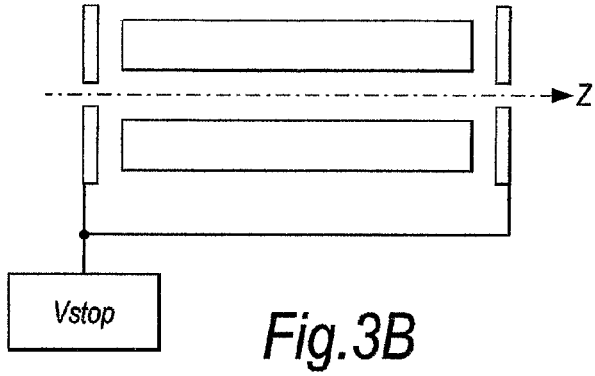
Figure 3C:
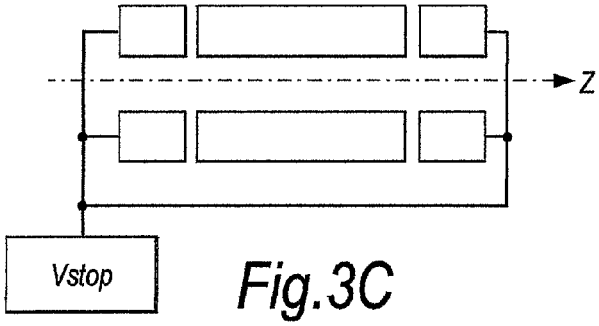
Figure 3D:
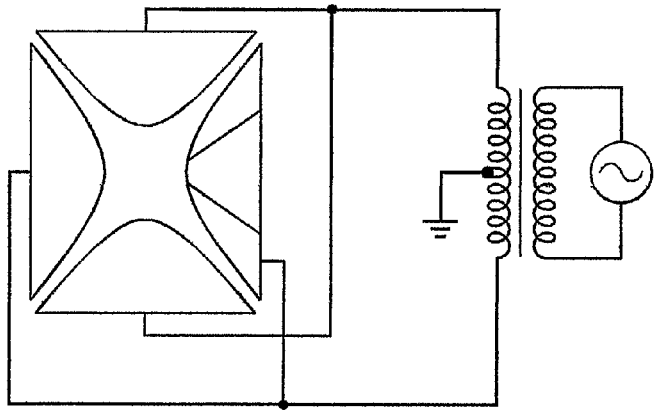

IT-TOF tandem can be built on the basis of 3D trap. Configuration of such instrument with ejection of ions out of the trap directly into the TOF flight path is presented on FIG. 2. However, such configuration suffers from low introduction efficiency mass discrimination and low charge capacity of a 3D trap. Preferred embodiments are based on the use of linear ion traps (LIT). Electrode geometry arrangement of the quadrupole LIT is shown in FIG. 3A. Such ion trap is created by 4 main trapping electrodes elongated parallel to the central axis of the trap (z-axis). The electrodes have preferably hyperbolical cross section that corresponds to the shape of equipotential surfaces for 2D quadrupole field (FIG. 3.D). All 4 electrodes are arranged symmetrically with respect to each other and at the same distance from z-axis. Such electrode configuration is capable of creating electrical field, which is most close to quadrupole field. Shape and position of electrodes can be modified in order to create distortions of quadrupole fields for some applications, and this included in the scope of current invention. Ions of certain mass range can be trapped within such electrode arrangement if a periodic trapping potential is applied to the electrodes. At the same time ions can leave the trapping volume along the axis. In order to prevent this from happening LIT have additional electrodes for creating potential barrier at the entrance and the exit of the trap. In the simplest case diaphragm electrodes at the entrance and the exit of the ion trap can create the DC barrier to prevent ions from leaving the trap along z-axis (FIG. 3B). Alternatively linear ion trap can be designed using segmented structure with 3 quadrupole segments arranged inline one after another (FIG. 3C). In this case the barrier is created by the DC voltage offset on the entrance and exit sections (with respect to the middle section). In both cases ion cloud is confined within the middle section of quadrupole and for further discussion the motion of ions along the z-axis is irrelevant.

Figure 4:
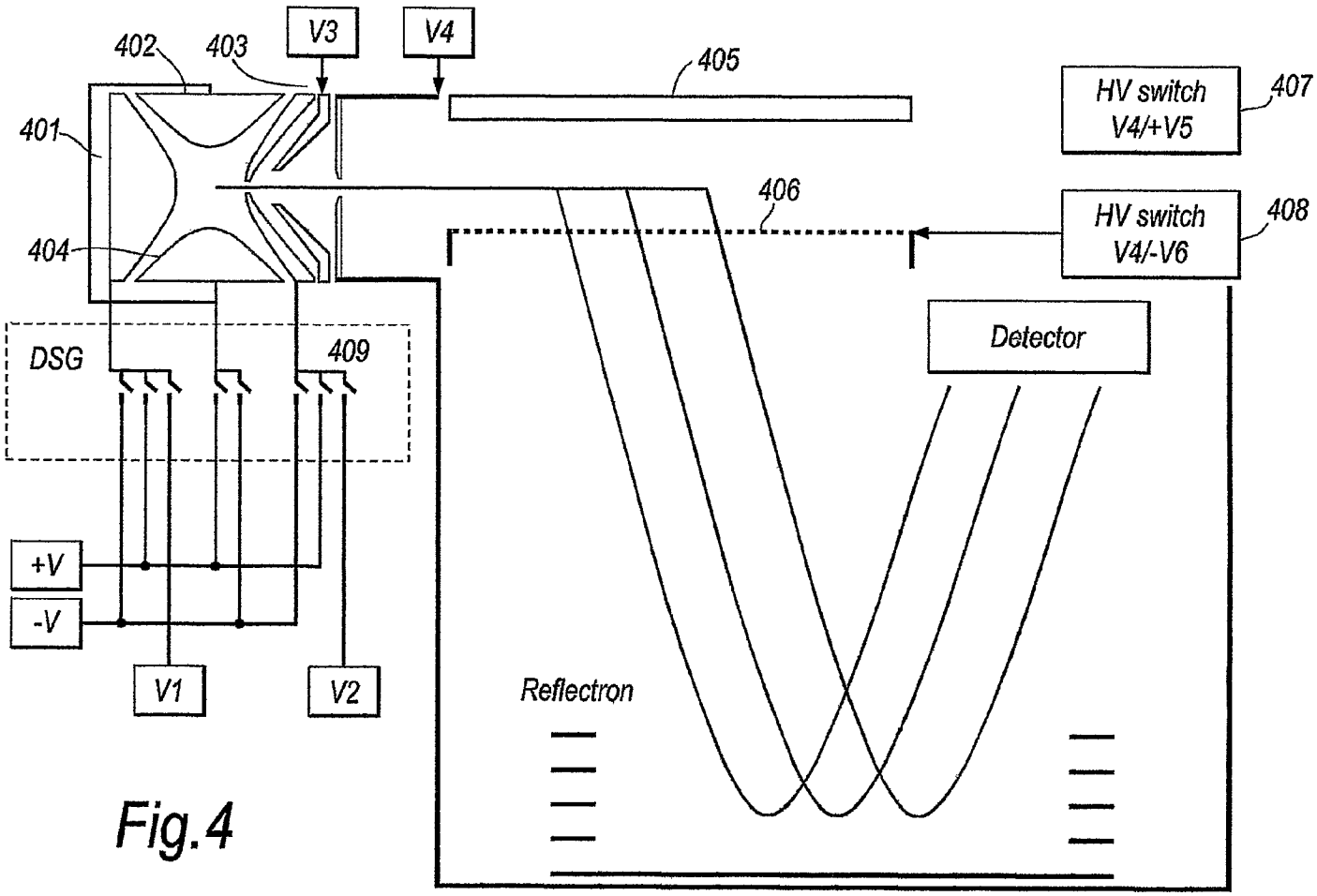
FIG. 4 is a cross section view of an IT-TOF tandem of the first preferred embodiment based on linear ion trap with ejection into the pulsar of the TOF.

Referring to FIG. 4 there is a cross-sectional view of a LIT-TOF tandem with ejection of ions out of the trap into pulsar volume, from which ions are accelerated into the TOF flight-path. The ion trap is created by 4 elongated electrodes 401, 403 (X electrodes) and 402, 404 (Y electrodes) with hyperbolic cross-section. One of the electrodes 401 has a slit for ejecting ions into a pulsar region. The pulsar is created by flat plate 405 and semitransparent flat mesh 406. High voltage switches 407 and 408 are connected to these electrodes and capable of producing a fast raising voltage pulses at appropriate time. Ion trap is operated by a set of electronic switches 409 under control of digital signal generator (DSG). These switches are capable of connecting and disconnecting a set of DC power supplies +V, −V, V1, V2 to the electrodes of the ion trap within 10-50 ns. Digital signal generator is capable of calculating a implementing and arbitrary switching sequence according with requirements. The instrument is operated as follows. Ions are formed in the ion source and injected into the ion trap along the z-axis near the centre of the trap. Ions are trapped within the trap by periodic disconnecting and connecting +V and −V voltage supply from electrodes of the trap in such way, that at any given time Y electrodes of the trap have the same polarity and X electrodes have also the same polarity but opposite sign with respect to Y electrodes. The durations of positive voltage and negative voltage are equal. Ions are cooled down by collisions with buffer gas down to the centre of the trap. At appropriate time both +V and −V power supply are disconnected from X electrodes. At the same time power supplies V1 and V2 are connected to electrodes 401 and 403 correspondingly. These voltage supplies are not disconnected from electrodes until all ions of interest will leave the ion trap in X direction towards pulsar as well as voltage supply for Y electrodes, which is preferably positive +V voltage supply (for positively charged ions). Time of voltage switching on X electrodes is controlled by DSG and can be adjusted in order to achieve the best performance. Electrodes of pulsar are connected to the same voltage V4, which is slightly lower than the voltage of the trap centre on application of the extraction voltages, so that on arrival into the pulsar ions will continue to drift along X axis and expand in Y direction. A high voltage power supplies V5 and V6, are connected to the electrodes of pulsar simultaneously at appropriate time and ions are accelerated into the flight path of TOF. In the ion mirror (Reflectron) ions are reversed back and focused in the plane of detector in such a way, that ions of the same mass-to-charge ratio arrive as close to each other as possible in time. A fast digitiser is used to record a signal from detector thus producing a mass spectrum.

Figure 5:
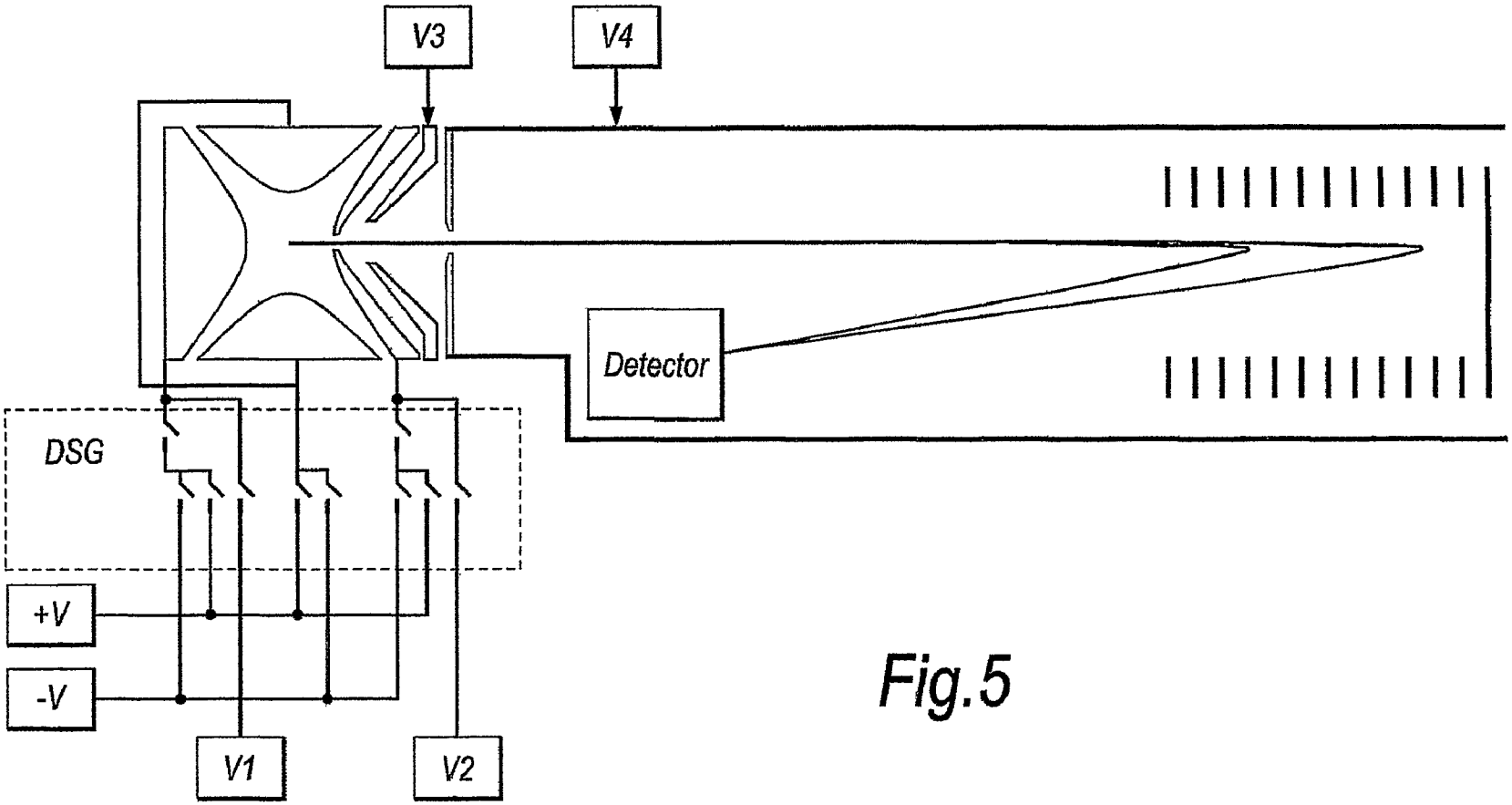
FIG. 5 is a cross section view of an IT-TOF tandem of the second preferred embodiment based on linear ion trap with ejection directly into the flight path of the TOF.

FIG. 5 shows the cross-sectional view of the second preferred embodiment: a LIT-TOF tandem with ejection of ions out of the trap directly into the TOF flight path. This configuration do not have pulsar and hence it requires high voltage supply V1 and V2 to be connected to electrodes of the trap for ejection of ions. The electronics include additional switches in order to protect the trapping circuit from high voltage. Instrument is operated similar to previous case with the following modifications. After sufficient cooling of the ion cloud the voltage supply on extraction X electrodes is disconnected from +V and −V power supplies and connected to high voltage supplies V1 and V2. The voltage supply on Y electrodes prior to extraction is preferably negative (for positively charged ions). The positive voltage supply +V is connected to the Y electrodes before extraction and stay connected for a time sufficient for ions to leave the trap. The time elapsed from the last voltage switching on Y electrodes and start of high voltage pulse on X electrodes is controlled by DSG and adjusted in order to achieve best performance of the instrument in terms of TOF resolution, mass accuracy or sensitivity.

For further discussion of preferred embodiments the preparation of the ion cloud within the ion trap is of importance. Modern ion traps operate under elevated pressure conditions (1-0.1 mTorr). Typically He buffer gas is used in order to provide momentum-dissipating collisions for ions. Such collisions assists with removing of excess kinetic energy during ion introduction process and provide means for cooling of the ion cloud. In some configurations a pulsed introduction of heavy gases (Ar, Xe, . . . ) is used in order to provide more energetic collisions during ion fragmentation step. Preparation steps can include several stages of ion cooling, selection of the ions of interest by removing ions of other mass-to-charge ratio out from the trap and fragmentation of selected ions. Isolation and fragmentation can be implemented by several methods known in the art. All the way of preparation of the ion cloud the ion trap operation can be very complicated. The trapping waveform (voltage or/and frequency) can be modified many times including slow scan and application of additional low voltage AC signals to the electrodes of the trap. Finally, ions are cooled down within the ion trap and prepared for extraction into TOF.

Figures 6, 7:
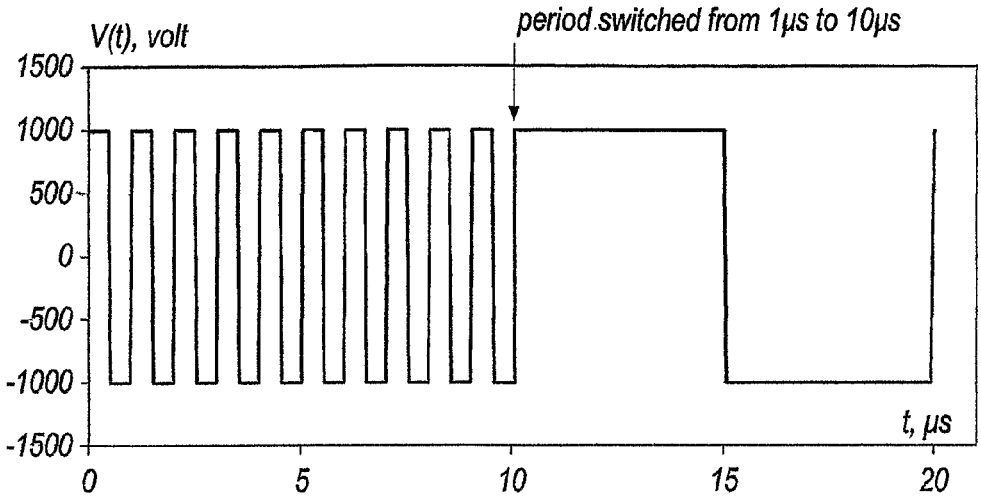
FIG. 6 is a time domain of digital drive before and after switching to a longer period.
FIG. 7 is a table of voltages on electrodes of the linear ion trap with digital drive for trapping and extraction.

Resolution and mass accuracy of final mass analysis is determined by TOF properties itself, but the process of ion ejection out of the trap is the most important factor in this. The core of invention is to create optimum conditions of ion ejection out of the trap, so that with any given TOF mass spectrometer the resolution can reach maximum possible value. This is achieved by creating conditions of electrostatic field inside the trap all the way during ejection, which is possible using "digital drive" for ion trap. Such driving method is described in patent application [9] the entire content of which is included here by reference. Unlike in conventional sinusoidal RF supply the voltages on the electrodes of the ion trap with digital drive are switched between discreet DC levels. In the simplest case the voltages are switched between two levels—positive and equal negative with the same duration of each level (square waveform with 50% duty cycle). A precise control of the period can be achieved with the help of digital controller. Using this method the period of waveform can be switched at any given time to a longer period. FIG. 6 shows the time dependence of voltage on one of the electrodes of the ion trap, which is driven by switching every 500 ns between two levels +1000V and −1000V giving a total period of 1 μs. At certain time, which is equal to 10 μs on FIG. 6, the period of square wave is changed to 10 μs. The voltage level on the electrode reaches constant value within less than 10-50 ns, and it is maintained for another 5 μs. During this time the extraction of ions into TOF can be performed. Voltages on the electrodes of the ion trap remain constant with high precision apart from raising edge of the extraction pulse, which can be made shorter than 10 ns. Ejection process happens in conditions of pure electrostatic field within the trap ("frozen field"). This provides means for optimising the ejection process for receiving best conditions for further processing. Such optimisation for TOF mass analysis of two preferred embodiments is provided later in this section.

FIG. 7 shows a table of voltages on the electrodes of LIT of the preferred embodiments, which are used for ion trapping and extraction. During the ion trapping mode the voltage on X pair of electrodes is switched from positive +V to negative −V value every cycle. The voltage of Y pair of electrodes is simultaneously switched to opposite sigh with respect to X electrodes. Voltage supply on the electrodes of LIT for ion trapping shown in FIG. 7 as "trap+" and "trap−". By using this simple trapping method a wide range of ions can be trapped. A more complicated trapping waveforms can be implemented by using a digital switch with several DC levels to drive each of the electrodes of the LIT and/or by introducing delay between waveforms in each electrode. Such methods of ion trapping are included in the scope of current invention. Extraction voltages V1 and V2 are applied to the X electrodes (different voltage on left and right electrodes) at appropriate time. For direct ejection into TOF flight path these voltages are preferably high (over 5 kV) in order to reduce turn-around time. For ejection into pulsar these voltages can be of the same order of magnitude as trapping voltage (from 200V to 2000V). Voltage supply on the electrodes of LIT during ejection is shown at FIG. 7 as "eject" configuration.

Figure 8A:
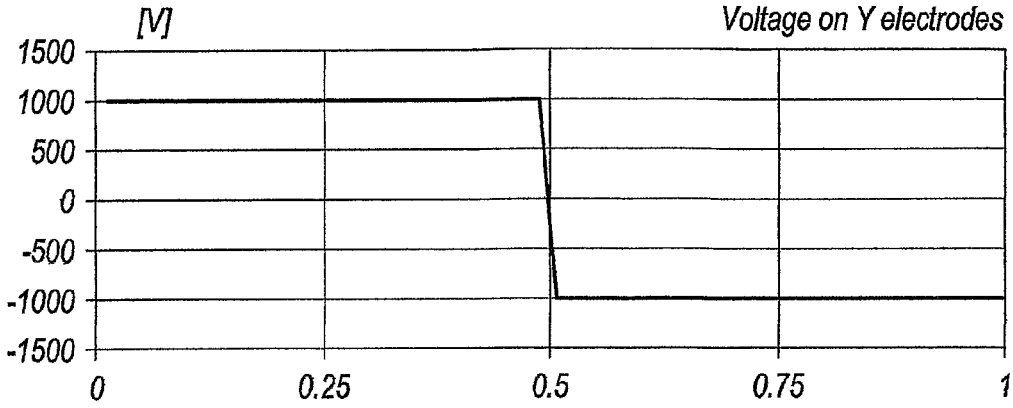
FIG. 8 is a phase dependence of the kinetic energy of the ion cloud in equilibrium conditions in a linear ion trap with square wave digital drive. A. Voltage waveform on Y electrode. B. Assembly average of kinetic energy in Y direction. C. Assembly average of kinetic energy in X direction.
Figure 8B:
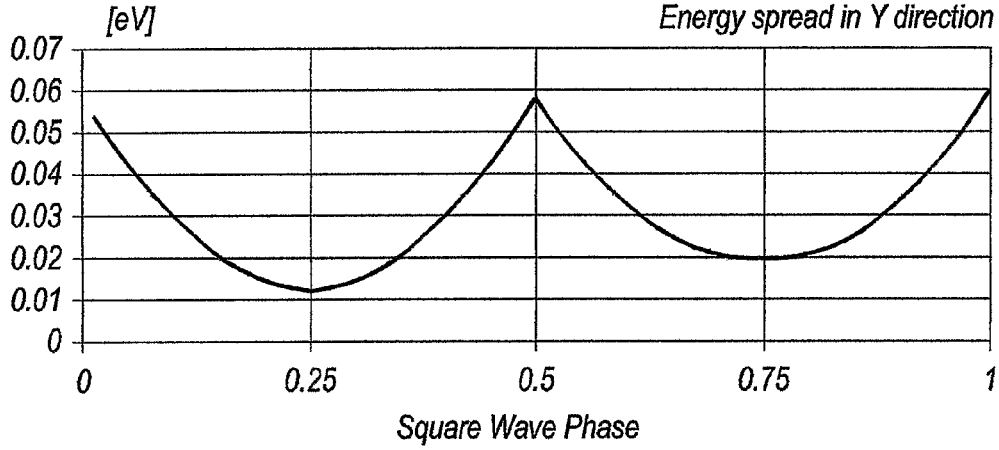
Figure 8C:
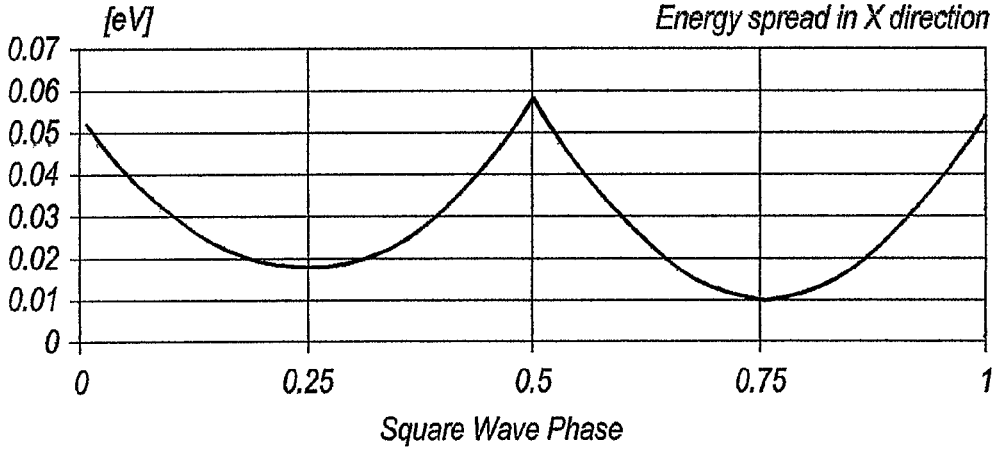

Further discussion of preferred embodiments is based on optimisation of the ejection process. For this the distribution of ion positions and velocity was investigated in detail. After sufficient cooling time ions are collected near the centre of the ion trap along the axis in a cigar-like cloud. Due to inherent nature of RF trapping, the energy spread of the ions in radial direction is phase dependant. This phenomena was investigated by using simulations of a big population of ions trapped in presence of He buffer gas at temperature 323 K. FIG. 8 shows the dependence of the average kinetic energy for singly charged ions of mass 1000 Da in a linear ion trap with inscribed radius ro=5 mm driven by square waveform at frequency 1 MHz and voltage levels +/−1000V. For convenience the voltage on Y electrodes over the cycle is shown on the upper graph of FIG. 8. It follows that the energy spread for radial direction is phase dependant and has two minima—at the middle of positive and negative phases of the voltage waveform. Thermal energy spread at 323 K equals kT/2=0.0139 eV. This value of energy spread is reached at phase 0.75 (middle of negative voltage on Y electrodes) for X motion and at phase 0.25 (middle of positive voltage on Y electrodes) for Y motion. Qualitatively the phase dependence of average kinetic energy is universal for ions of a different mass-to-charge ratio differing slightly in the actual values of minimum and maximum energy.

Figure 9:
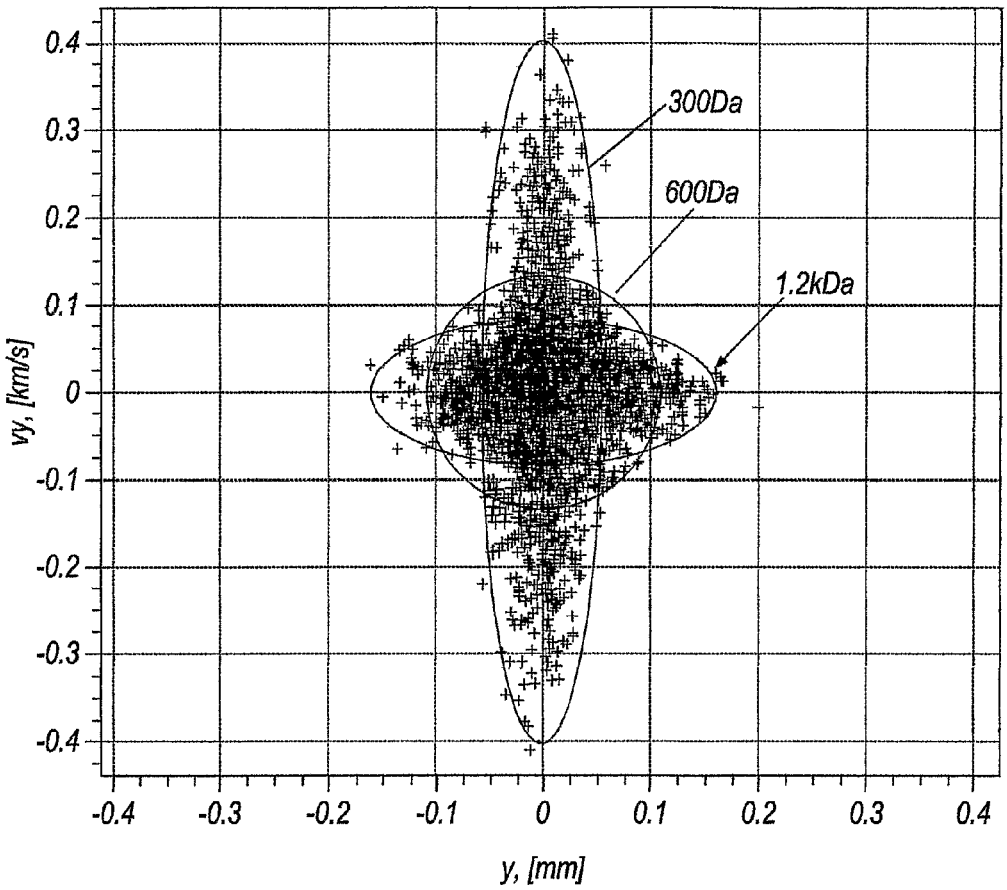
FIG. 9 is a phase space distribution of ions for Y direction at the phase 0.25 of the square wave digital drive (middle of positive voltage on Y electrodes).
Figure 10A:
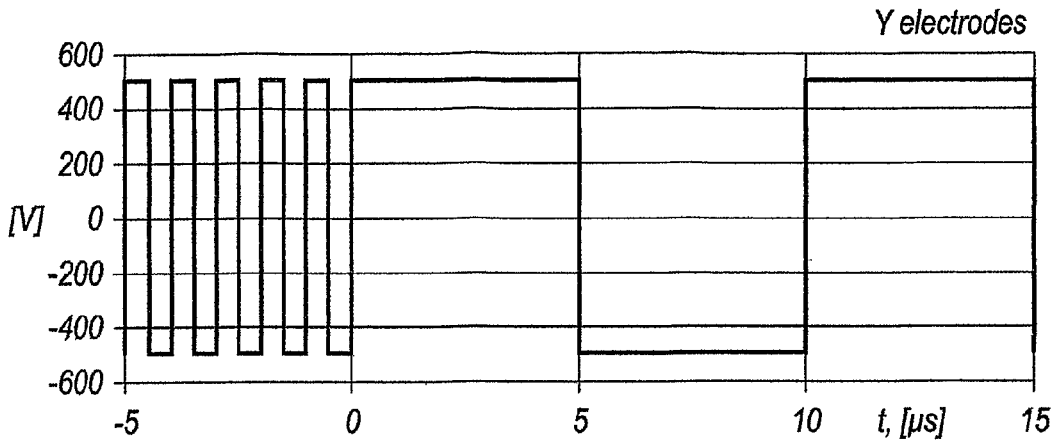
FIG. 10 are voltage waveforms on the electrodes of the ion trap just before and during ejection into pulsar for positively charged ions. A. Voltage on Y electrodes of the trap. B. Voltage on left X electrode. C. Voltage on right X electrode (electrode with ejection slit).
Figure 10B:
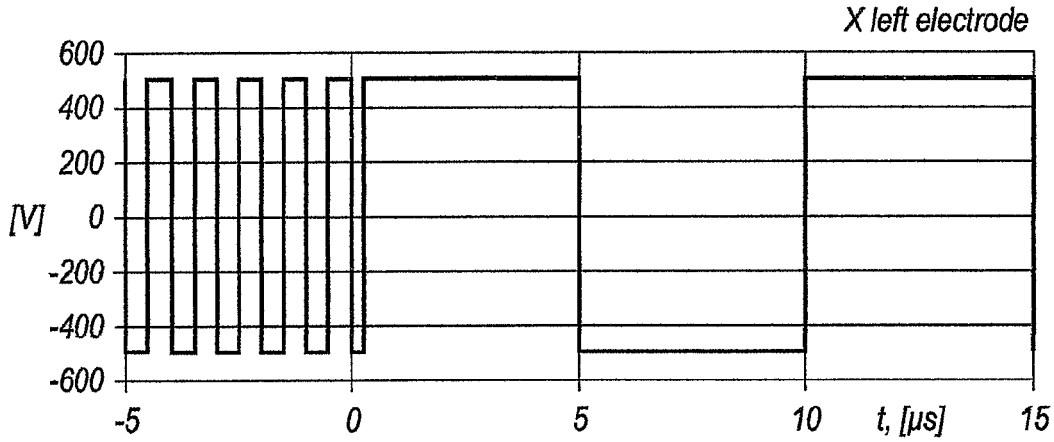
Figure 10C:
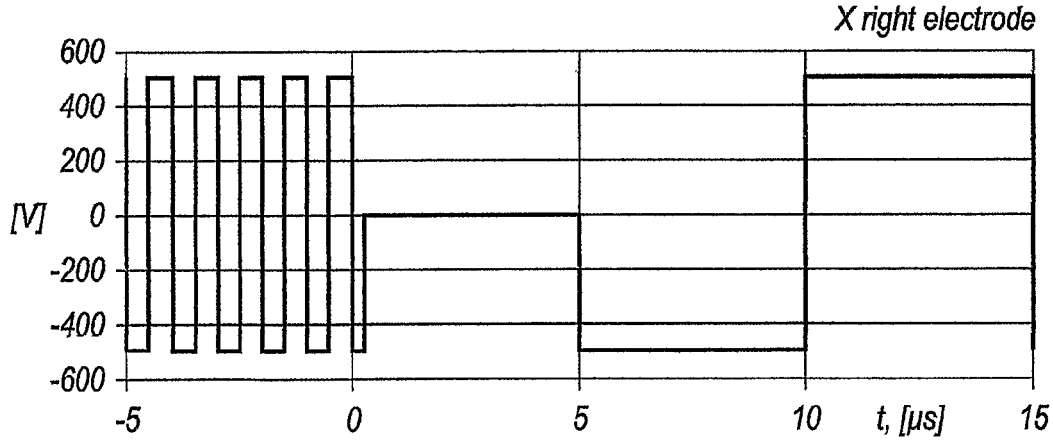

For minimising the velocity spread of the ions prior to ejection into TOF the extraction pulse should be applied when the energy spread is minimal. For example for IT-TOF with extraction into a pulsar (FIG. 4) the optimum phase should be 0.25, because it gives smallest spread in Y direction (direction of acceleration from pulsar into TOF). Phase space distribution of ion cloud for Y direction at phase 0.75 is presented in FIG. 9. It was used as an initial condition for simulations of ion ejection into pulsar. Ejection process was simulated with voltages on the electrodes of the ion trap as presented in FIG. 10. The switching period for Y electrode is changed from 1 μs to 10 μs. The time when it happens corresponds to t=0 in FIG. 10. Preferably positive voltage on Y electrodes should be used for ejection of positively charged ions. Voltages on X electrodes are switched to a negative DC level as in trapping mode. Some time Δt after this a negative power supply is disconnected from X electrodes and a different voltage supply V1 and V2 is connected to left and right X electrodes respectively. In FIG. 10 these voltages are equal to 500V and 0V. Time duration Δt can be adjusted in order to achieve best performance. For smallest velocity spread of ions in Y direction (direction of further acceleration into TOF) it is useful to take Δt equal to the quarter of the switching period just before extraction. In example of FIG. 10 this time equals 250 ns. Time of connecting V1 and V2 to X electrodes is referred further as start of ejection.

Figure 11:
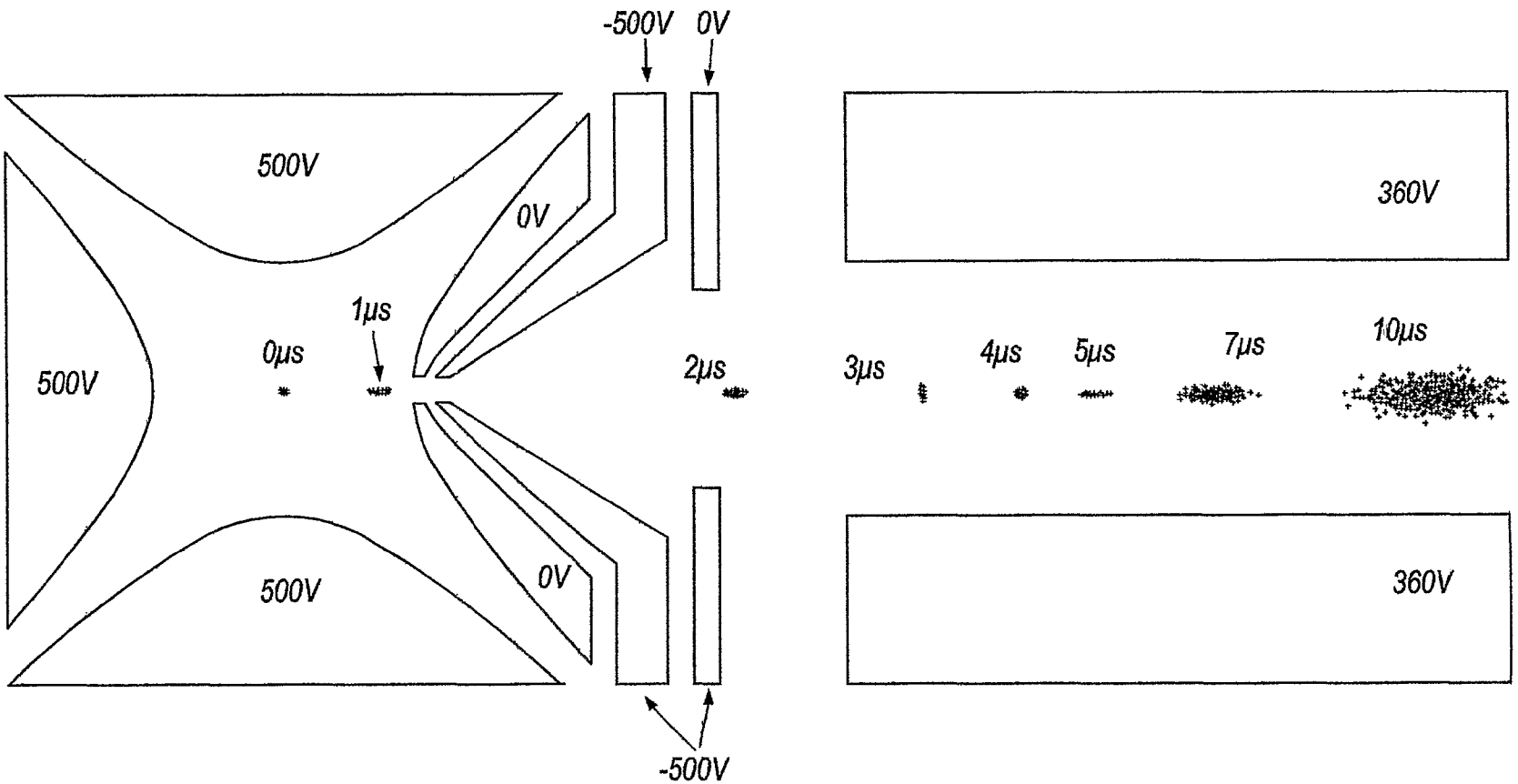
FIG. 11 is a voltage supply for extraction and position of 600 Da ions at different time during extraction.
Figure 12:
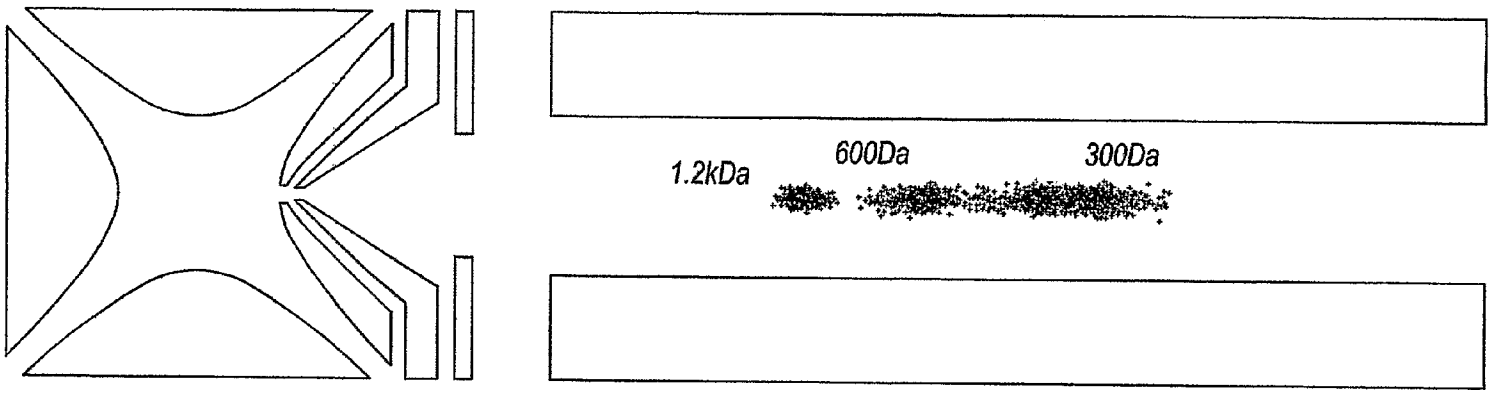
FIG. 12 is a distribution of position of ions 300 Da, 600 Da and 1200 Da on arrival into the pulsar region of TOF (10 μs after start of extraction).
Figure 13:
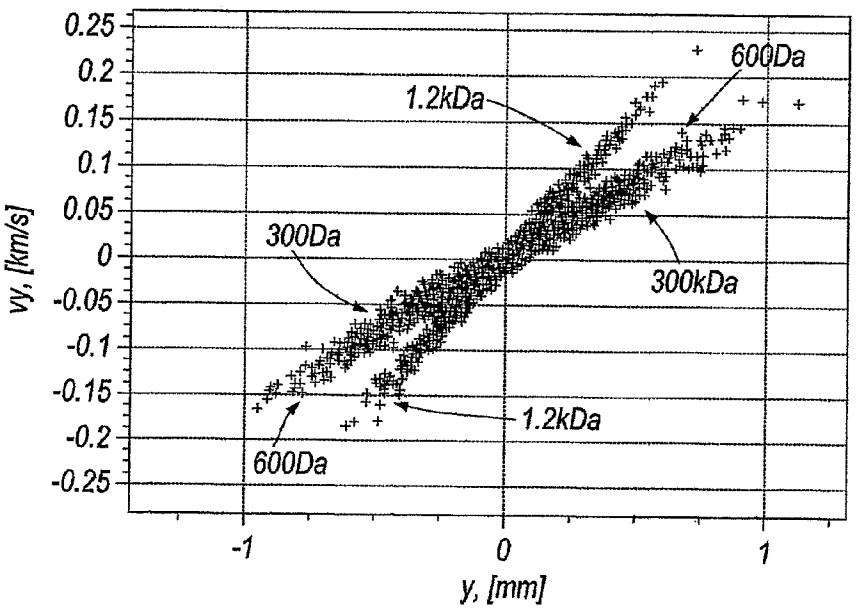
FIG. 13 is a phase space distribution of ions in Y direction on arrival into the pulsar region (10 μs after start of extraction).

FIG. 11 shows the cross-section of a LIT and a pulsar region of first preferred embodiment. Position of the ion cloud of singly charged ions of mass 600 Da at different time from the start of ejection is shown. During ejection the ion cloud experiences several compressions and decompressions in Y and X direction. Upon arrival into pulsar (after 7 μs) the ion cloud starts to spread in both directions (as in field free region). Ions of different mass-to-charge ratio arrive into the pulsar at different time. This is a usual problem of methods based on extraction into external pulsar. Only a limited mass range of ions can be present within the pulsar upon application of the extraction pulse. For current geometry the positions of singly charged ions of mass 300 Da, 600 Da and 1200 Da upon arrival into the pulsar (10 μs after start of ejection) is shown in FIG. 12. This is the right time for applying another extraction pulse (high-voltage) to the opposite electrodes of the pulsar in order to accelerate ions into the flight path of TOF. The phase space distribution of ions in pulsar region at 10 μs is presented in FIG. 13. Velocity spread of 600 Da ions is below 300 m/s. With acceleration voltage of 10 kV the turn-around time is estimated to be 6.2 ns. With a typical flight time of 100 μs this gives a maximum resolution of TOF spectra of 16.000. Although it was not attempted here, further optimisation of velocity spread and TOF resolution is possible by using different extraction voltages on the electrodes of the trap and by traditional ion optics between ion trap and pulsar.

Figure 14:
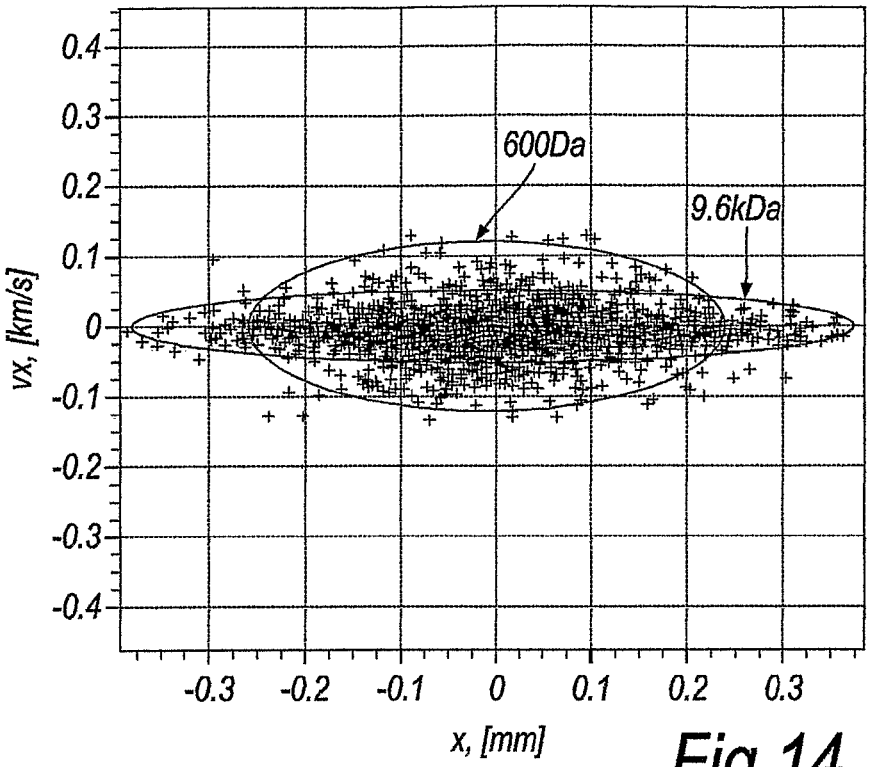
FIG. 14. is a phase space distribution of ions for X direction at the phase 0.75 of the square wave digital drive (middle of negative pulse on the Y electrodes).
Figure 16:
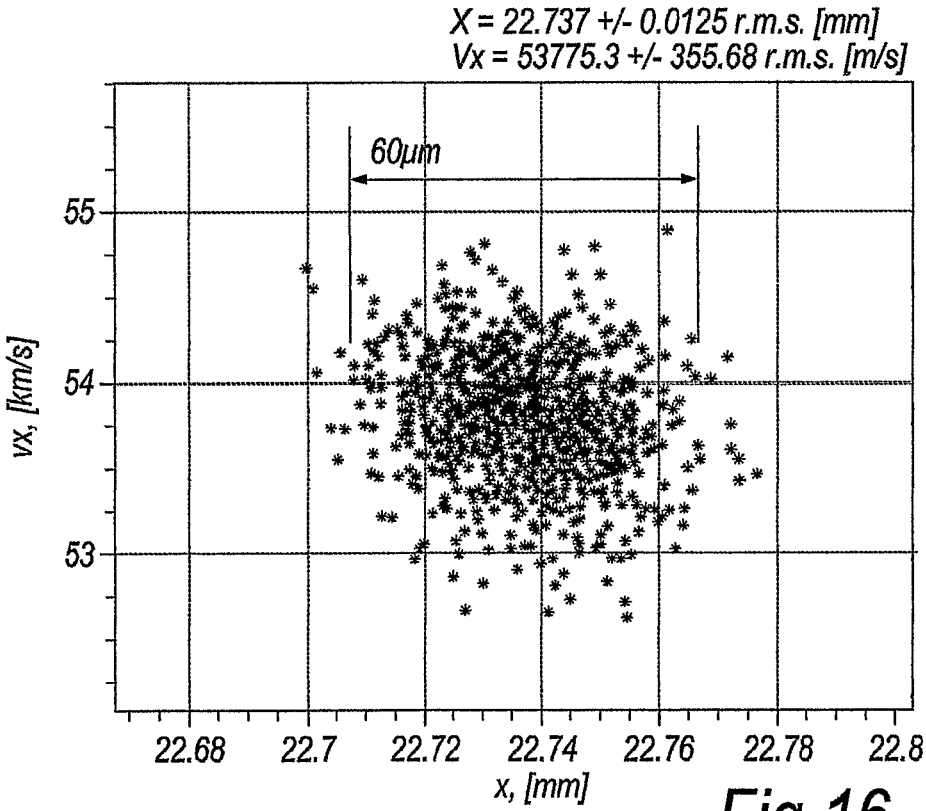
FIG. 16 is a phase space distribution of 600 Da ions in X phase space in the first order focus.
Figure 15:
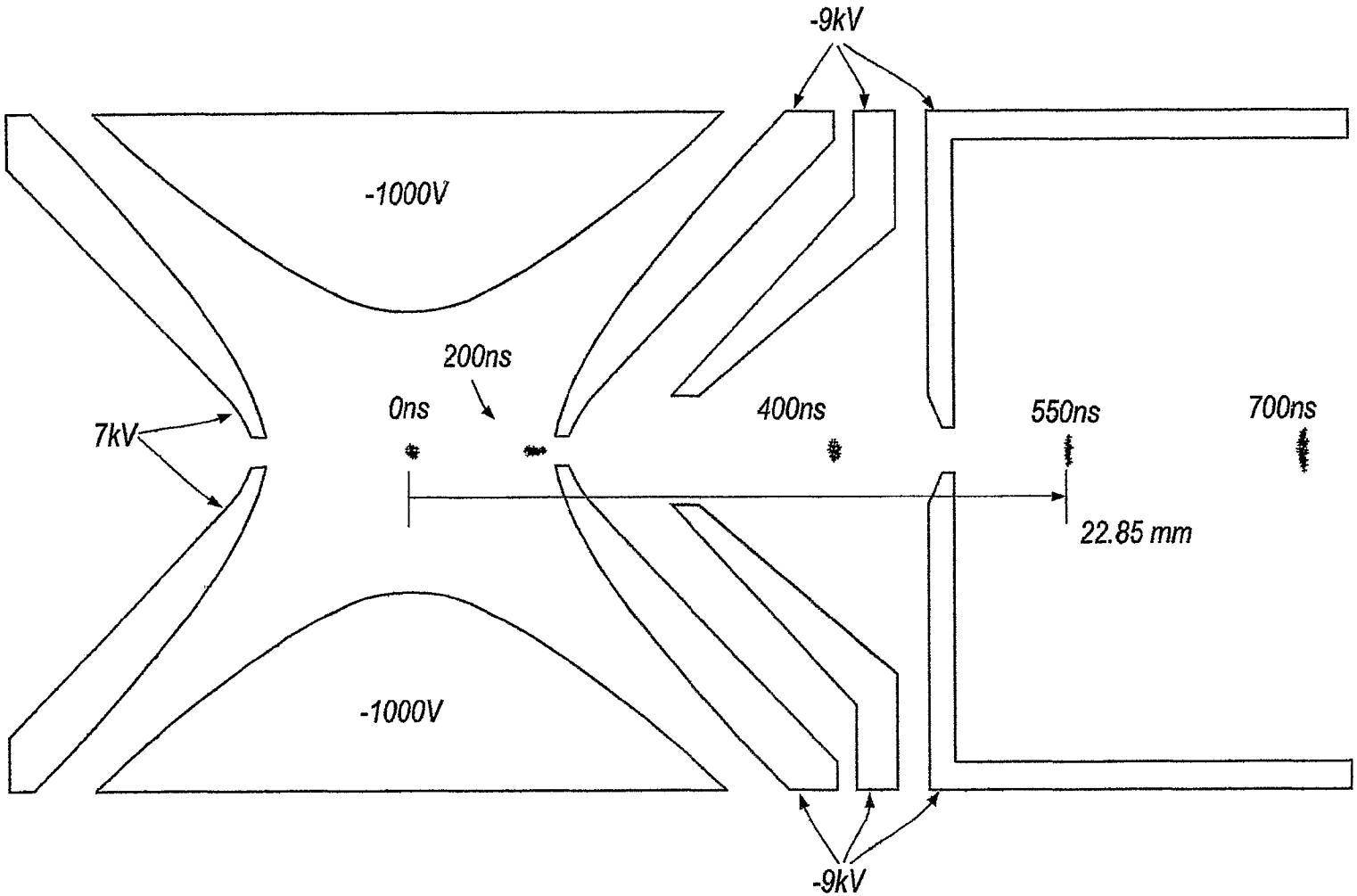
FIG. 15. is result of simulation of the ejection of singly charged 600 Da ions into the ion path of TOF mass spectrometer. Positions of the ion cloud consisting of 1000 ions are shown at different time from the start of ejection.
Figure 17:
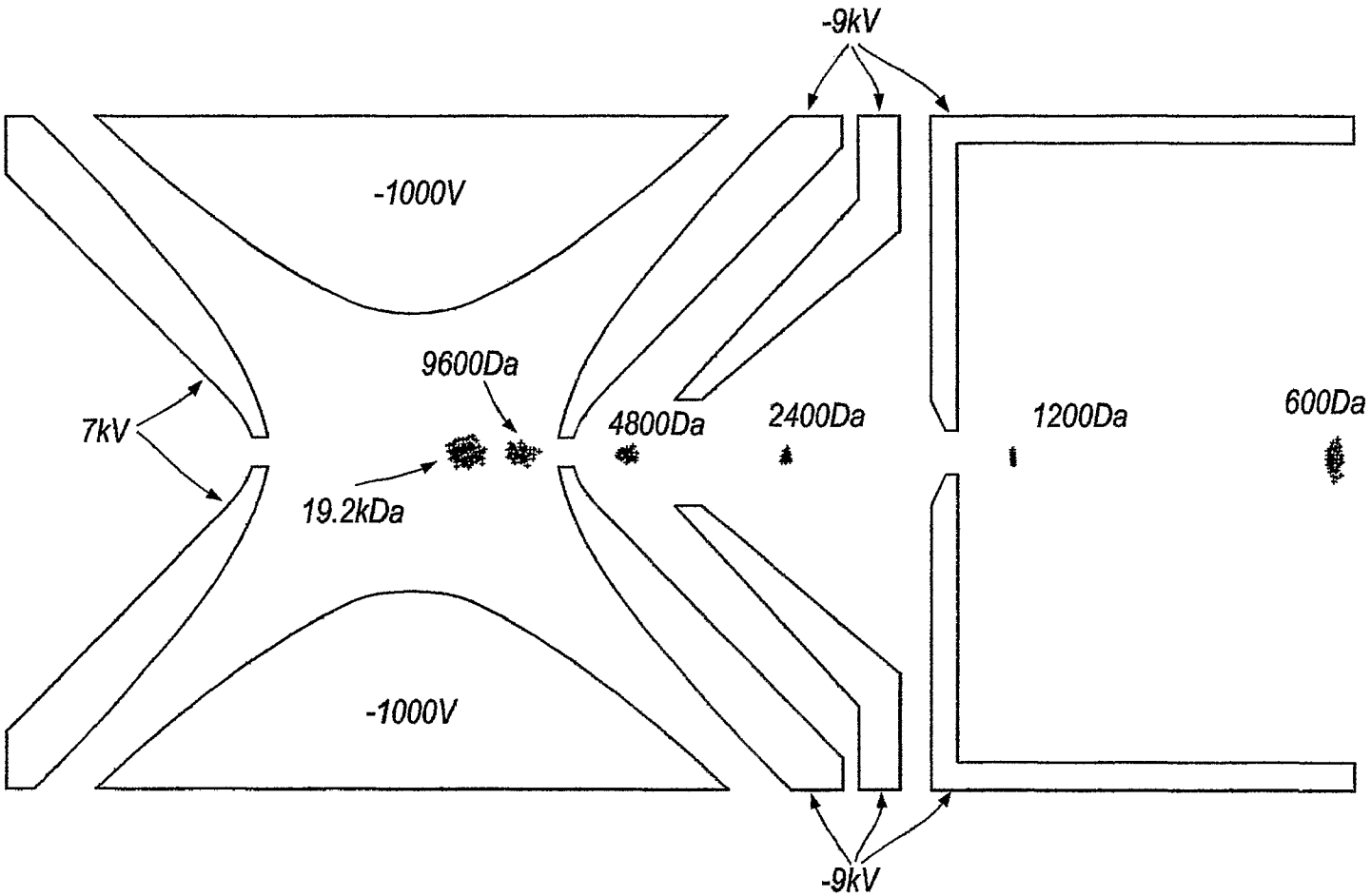
FIG. 17 are position of ions (singly charged) of different mass at 750 ns after the start of ejection.

For a configuration with ejection directly into the TOF flight path (X direction) the moment of applying extraction pulse should be close to 0.75 phase as it provides minimum velocity spread of ions in X direction. Phase space distribution of initial positions of ions in X phase space at phase 0.75 (middle of negative voltage on Y electrodes) is presented in FIG. 14. In this particular example the extraction voltages should be applied 250 ns (quarter of the period) from the beginning of negative pulse on Y electrodes. Just before ejection the period of square wave is switched from 1 μs (frequency 1 MHz) to 10 μs (frequency 100 kHz). Negative voltage on Y electrodes is kept for another 5 μs, which is enough to eject all ions out of the trap. The actual waveforms on each of the electrodes of the linear ion trap are similar to presented in FIG. 10 with a following differences: just before the start of ejection voltage on Y electrodes is negative, voltage on X electrodes is positive and extraction voltages are much higher. Position of the ion cloud of 600 Da ions at different time from the beginning of extraction is presented in FIG. 15. At the distance of 22.85 mm from the trap centre (550 ns after start of ejection) the ion cloud has a first order focus. Distribution of ion positions in the first order focus is presented in FIG. 16. The width of the ion cloud in first order focus is 60 μm and average velocity is 54 km/s. This focusing point of the cloud can be considered as a virtual source for TOF mass spectrometer. After passing the focus point the ion cloud starts to spread again, but in the ion mirror of TOF (reflectron) ions are reversed back and focused into detector. Assuming that reflectron is built in such a way, that it focuses the ion cloud to a size which is at least not worse than the size of the virtual source, the resolution of mass spectra with typical flight path of 3 m equals 3 m/(2*60 μm)=25.000. Such resolution is considered as high for TOF mass analysis. Hence the proposed method allows for receiving TOF mass spectrum of high resolution. Mass accuracy of TOF mass spectrum is believed to be of the same order because ions of different mass-to-charge ratio are ejected at the same electrostatic "frozen field" conditions and hence have essentially equal energy apart from thermal energy spread.

It worth mentioning that the resolution can be further optimised by the adjusting of the extraction voltages and by using traditional ion optics on the flight path of ions from ion trap into TOF. Such methods are known in the art and are included within the scope of current invention.

Figure 18:
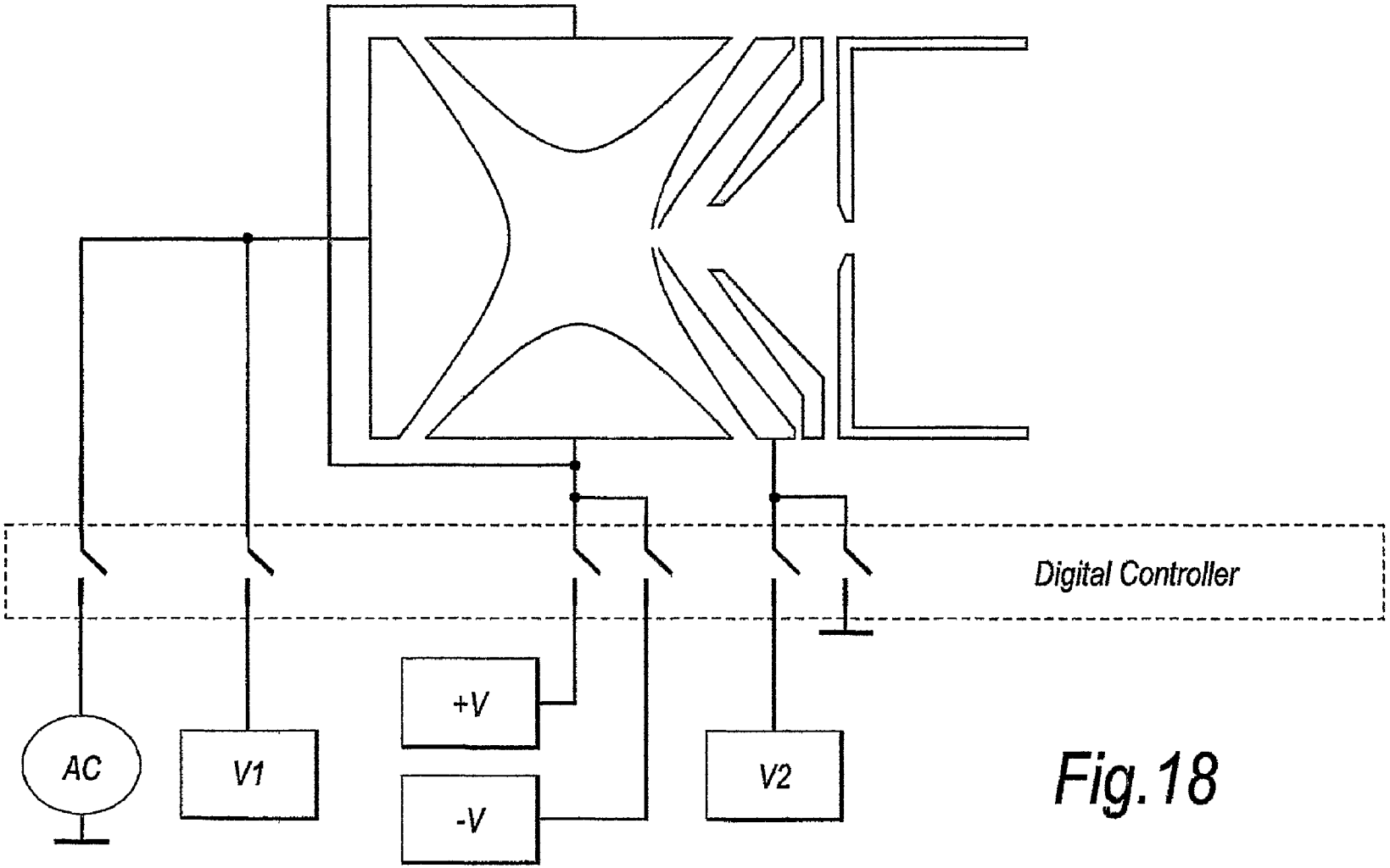
FIG. 18 is a quadrupole linear ion trap with digital trapping voltage on Y electrodes only and extraction pulses applied at X electrodes.

FIG. 18 shows a cross section of a linear ion trap and voltage supply using digital switching method, which are used in 3-d preferred embodiment. In this case trapping of ions is achieved by switching between two discreet DC levels on the Y electrodes of trap only. High voltage power supplies for extraction are connected to X electrodes of the trap through electronic switch, which is controlled by DSG and connected only for ejection. During normal trapping and cooling the voltages on X electrodes are constant (zero). An additional AC power supply for generating excitation waveforms is shown on FIG. 18. This power supply is required for ion isolation and activation during preparation of the ion cloud before ejecting into TOF. An advantage of this configuration is isolation of trapping switches from high voltage switch. Thus such configuration does not require additional switches to protect trapping circuitry from high voltage. Such configuration is a most simple practical implementation of the proposed method.

LITERATURE

[1] L. He, Y.-H. Liu, Y. Zhu and D. M. Lubman, *Detection of Oligonucletides by External Injection into Ion Trap Storage/Reflectron Time-of-Flight Device*, Rapid Comm. Mass Spectrom., vol. 11, pp. 1440-1448 (1997).

[2] V. M. Doroshenko and R. J. Cotter, *A Quadrupole Ion Trap/Time-of-flight Mass Spectrometer with a Parabolic Reflectron*, Journal of Mass Spectrom., vol. 33, pp. 305-318 (1998).

[3] Buttrill S. E., Morderhai A. V, Apparatus for and method of forming a parallel ion beam, U.S. Pat. No. 5,569,917, Oct. 29, 1996.

[4] Kawato E., Time-of-flight mass spectrometer, U.S. Pat. No. 6,380,666, Apr. 30, 2002.

[5] A. Okumura et. al, Mass spectrometer and measurement system and method for TOF mass spectrometry, European patent application, EP 1 302 973 A2, 23.05.2002.

[6] Scwartz J. C. et all, *A Two-Dimensional Quadrupole Ion Trap Mass Spectrometer*, JASMS, v. 13, 2002, p. 659.

[7] Douglas D., Campbell J, Collings B., Method of analysing ions in apparatus including a time-of-flight mass spectrometer and a linear ion trap, International patent application WO 99/30350, 17 Jun. 1999.

[8] J. Franzen, Method and device for orthogonal ion injection into a time-of-flight mass spectrometer, U.S. Pat. No. 5,763,878, Jun. 9, 1998.

[9] Li Ding and M. Sudakov, International patent application WO 03041107.

[10] Li Ding, M. Sudakov and S. Kumashiro, *A Simulation Study of the digital ion trap mass spectrometer, Int. Journal of Mass Spectrometry*, v. 221, pp. 117-139, (2002).

The invention claimed is:

1. A method of optimizing ion distribution of ion position and velocity and extracting ions from a linear ion trap to time-of-flight mass spectrometer, said ion trap being driven by a set of digital switches, said method comprising the following steps:

trapping said ions in said ion trap by applying trapping voltages having waveform created by fast switching of the application on electrodes of said ion trap between discrete positive and negative DC levels in a short switching period;

cooling said trapped ions by collisions with a buffer gas down to equilibrium; and extracting the trapped ions in said ion trap to said time-of-flight mass spectrometer by applying extracting levels on the electrodes of said ion trap under conditions, where at least one pair of the electrodes are kept at a constant value of positive or negative DC level over a period which is longer than said switching period.

2. A method of extracting ions from a linear ion trap as claimed in claim 1, where a set of trapping states defined by the discrete positive and negative DC levels applied on the electrodes of said ion trap in said trapping step consists of two states, each of said states lasts for half of said short switching period.

3. A method of extracting ions from a linear ion trap as claimed in claim 2, wherein said short switching period is in the range from 0.3 micro seconds to 1.0 micro seconds.

4. A method of extracting ions from a linear ion trap as claimed in claim 2, where the final trapping state prior to said ejection state has a duration of approximately one quarter of said short switching period.

5. A method of extracting ions from a linear ion trap as claimed in claim 1, wherein said buffer gas fills said ion trap at pressures in the range from 0.01 mTorr to 1 mTorr.

6. A method of extracting ions from a linear ion trap as claimed in claim 1, wherein an opposite pair of electrodes (Y pair) of said set of electrodes is connected to a first subset of said digital switches capable of switching at a repetition rate, and at least one of another oppositely positioned pair of electrodes (X pair) of said set of electrodes is connected to a second subset of said number of said digital switches which has a higher voltage rating, said second subset of digital switches connects DC voltage supply to said X electrodes for election of said ions.

7. A method of extracting ions from a linear ion trap as claimed in claim 6, wherein said first subset of said number of said digital switches includes 2 serially linked high repetition switches, switching between a positive and negative voltage to provide said Y pair of electrodes of said electrodes with a rectangular waveform.

* * * * *